US006510605B1

(12) United States Patent
Smejkal et al.

(10) Patent No.: US 6,510,605 B1
(45) Date of Patent: Jan. 28, 2003

(54) METHOD FOR MAKING FORMED SURFACE MOUNT RESISTOR

(75) Inventors: Joel J. Smejkal; Steve E. Hendricks; Larry K. Sockrider, all of Columbus, NE (US)

(73) Assignee: Vishay Dale Electronics, Inc., Columbus, NE (US)

( * ) Notice: Subject to any disclaimer, the term of this patent is extended or adjusted under 35 U.S.C. 154(b) by 0 days.

(21) Appl. No.: 09/471,617

(22) Filed: Dec. 21, 1999

(51) Int. Cl.[7] ..... H01C 17/28

(52) U.S. Cl. ..... 29/619; 29/610.1; 29/620; 338/293; 338/308; 338/314

(58) Field of Search ..... 29/621, 619, 411; 338/293, 308, 309, 22 R, 22 SD, 314

(56) References Cited

U.S. PATENT DOCUMENTS

| | | | |
|---|---|---|---|
| 696,757 | A | 4/1902 | Rypinski |
| 765,889 | A | 7/1904 | Harris |
| 779,737 | A | 1/1905 | Robinson |
| 859,255 | A | 7/1907 | Roller |
| 1,050,563 | A | 1/1913 | Roller |
| 2,003,625 | A | 6/1935 | Boyer |
| 2,271,995 | A | 2/1942 | Baroni |
| 2,708,701 | A | 5/1955 | Viola |
| 2,736,785 | A | 2/1956 | DuBois |
| 3,245,021 | A | 4/1966 | Kernander et al. |
| 4,286,249 | A | 8/1981 | Lewis et al. |
| 4,684,916 | A | 8/1987 | Ozawa |
| 4,689,475 | A | 8/1987 | Kleiner et al. |
| 4,800,253 | A | 1/1989 | Kleiner et al. |
| 4,993,142 | A | 2/1991 | Burke et al. |
| 5,287,083 | A | 2/1994 | Person et al. |
| 5,604,477 | A | 2/1997 | Rainer et al. |

FOREIGN PATENT DOCUMENTS

| | | |
|---|---|---|
| DE | G9320911.8 | 6/1995 |

OTHER PUBLICATIONS

Issue date Nov. 1978. Publication: Electronic Packaging and Production Advances In Connector Design Using Electron Beam Welded Strip R.M. Grubb and D.W.M. Williams Technical Materials, Inc., 5 Wellington Rd., Lincoln, Rhode Island 02865.

*Primary Examiner*—Peter Vo
*Assistant Examiner*—Sean Smith
(74) *Attorney, Agent, or Firm*—McKee, Vorhees & Sease, P.L.

(57) ABSTRACT

A surface mount resistor is formed from an elongated resistive body having first and second terminal ends and a raised center portion formed therebetween. The raised center portion includes slots in its edges which form a serpentine current path through the raised center portion of the resistor. A dielectric surrounds and encapsulates the raised center portion and an electrically conductive material coats the first and second terminal ends. The method for manufacturing involves utilizing an elongated ribbon which is of unitary construction and which is formed to create a carrier strip and a raised center portion for the resistors ultimately to be formed.

7 Claims, 7 Drawing Sheets

METHOD FOR MAKING FORMED SURFACE MOUNT RESISTOR

BACKGROUND OF THE INVENTION

The present invention relates to a formed surface mount resistor and method for making same.

Surface mount resistors have been available for the electronics market for many years. Their construction has comprised a flat rectangular or cylindrically shaped ceramic substrate with a conductive metal plated to the ends of the ceramic to form the electrical termination points. A resistive metal is deposited on the ceramic substrate between the terminations, making electrical contact with each of the terminations to form an electrically continuous path for current flow from one termination to the other.

An improvement in surface mount resistors is shown in U.S. Pat. No. 5,604,477. In this patent a surface mount resistor is formed by joining three strips of material together in edge to edge relation. The upper and lower strips are formed from copper and the center strip is formed from an electrically resistive material. The resistive material is coated with epoxy and the upper and lower strips are coated with tin or solder. The strips may be moved in a continuous path for cutting, calibrating, and separating to form a plurality of electrical resistors.

A primary object of the present invention is the provision of an improved formed surface mount resistor and method for making same.

A further object of the present invention is the provision of a method for making a formed surface mount resistor which utilizes a single ribbon of material for the resistor body and the carrier strip.

A further object of the present invention is the provision of an improved formed surface mount resistor and method for making same which reduces the number of steps and improves the speed of production from that shown in U.S. Pat. No. 5,604,477.

A further object of the present invention is the provision of an improved formed surface mount resistor and method for making same wherein the resulting resistor is efficient in operation and improved in quality.

A further object of the present invention is the provision of a formed surface mount resistor and method for making same which is economical to manufacture, durable in use and efficient in operation.

SUMMARY OF THE INVENTION

The foregoing objects may be achieved by a surface mount resistor comprising an elongated resistive body formed from a single piece of electrically resistive material. The resistive body includes first and second terminal ends and a raised center portion positioned above first and second terminal ends. The raised center portion includes first and second opposite edges and has a plurality of slots extending into the lateral edges so as to create a serpentine current path through the raised center portion from first terminal end to the second terminal end. A dielectric material surrounds and encapsulates the raised center portion. An electrically conductive material coats the first and second terminal ends.

The method for making the surface mount resistor of the present invention comprises taking an elongated ribbon of electrically resistive material having upper and lower ribbon edges. The ribbon is partially separated into a plurality of individual body members, each having opposite side edges and first and second terminal ends with a central portion therebetween. The ribbon includes a carrier portion interconnecting the plurality of body members. A plurality of slots are formed in the opposite side edges of the body members so as to create a serpentine current path from the first terminal end through the central portion to the second terminal end in each of the body members. The cross sectional shapes of the body members are then formed so that the central portion is raised above the first and second terminal ends. The raised central portion is then encapsulated within a dielectric material and the terminal ends of the body members are coated with an electrically conductive material.

In one embodiment of the method the step of forming the cross sectional shape of the body members is performed by forming the ribbon before the separating step is accomplished.

In another embodiment of the method of the present invention the step of forming the cross sectional shape of the body members is performed on the body members after the separating step has been performed.

Various types of forming methods may be used, including roll forming to create the forming of the raised portion or stamping may also be used. Preferably the roll forming method is used when the forming is accomplished before separating the strip into the various body members. Stamping is the preferred method if the forming is accomplished after the body members have been separated.

DETAILED DESCRIPTION OF THE PREFERRED EMBODIMENT

Figure 1:
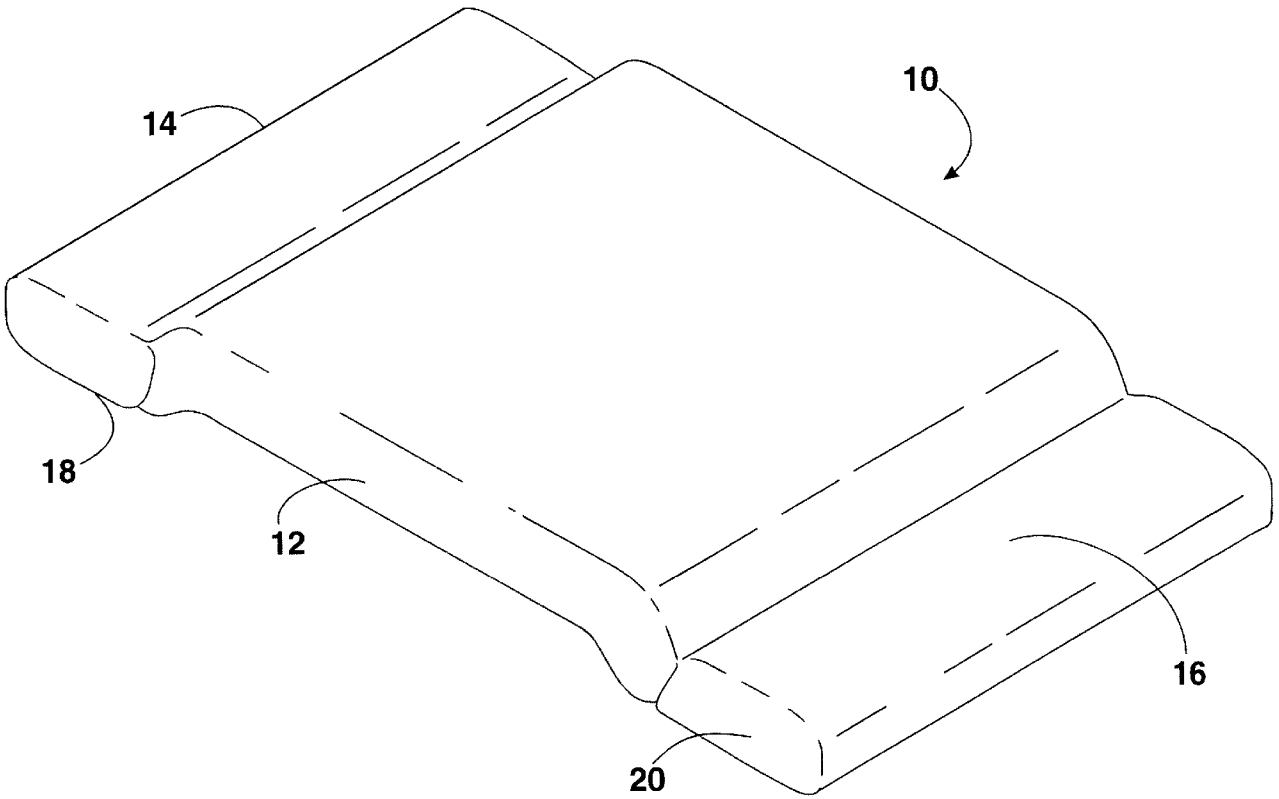
FIG. 1 is a perspective view of a resistor made according to the present invention.

Referring to the drawings the numeral 10 generally designates the surface mount resistor of the present invention. Resistor 10 includes a raised center 12 and first and second end terminals 14, 16. The bottom surfaces of terminals 14, 16 form first and second stand offs 18, 20 which permit the resistor to be mounted on a surface with the raised center 12 spaced above the surface on which the resistor is mounted.

Figure 2:
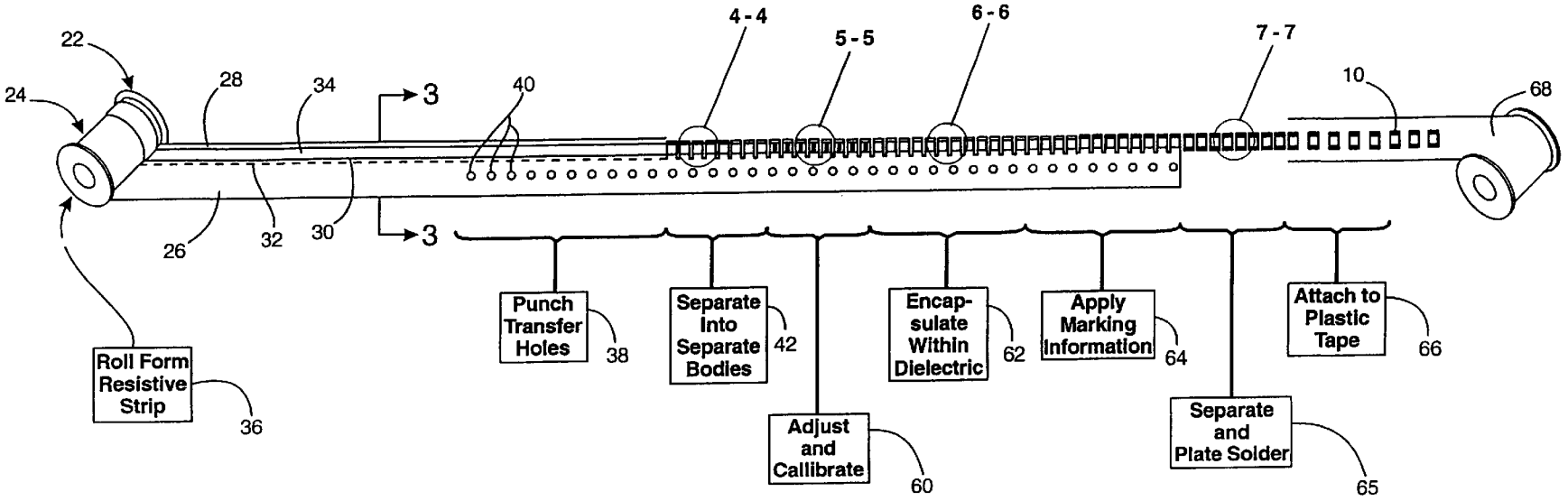
FIG. 2 is a schematic flow diagram showing the process for making the present resistor.
Figure 3A:
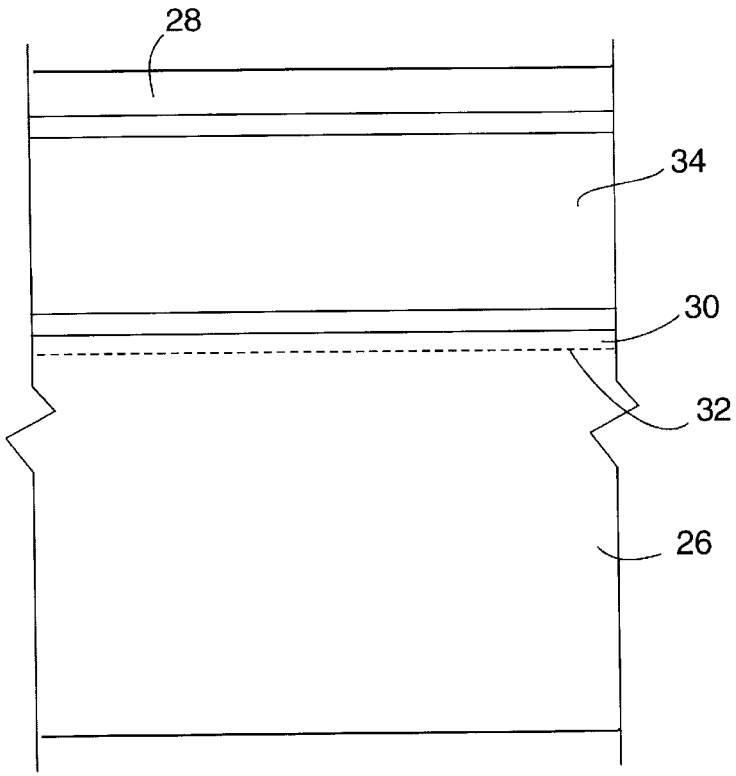
FIG. 3A is an elevational view taken from the left of FIG. 3.
Figure 3:
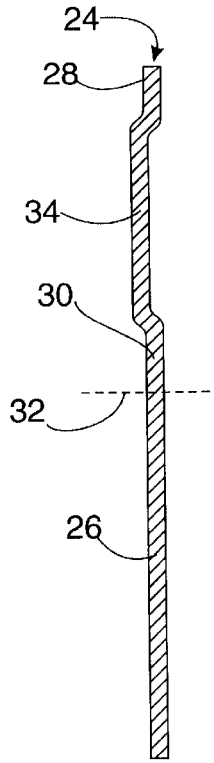
FIG. 3 is an enlarged sectional view taken along line 3—3 of FIG. 2.

FIG. 2 shows a schematic representation of the method for manufacturing the resistor of the present invention. A reel 22 includes a unitary ribbon 24 wound around it. The ribbon 24 is shown in enlarged detail in FIGS. 3 and 3A. It includes a carrier portion 26, an upper terminal portion 28, and a lower terminal portion 30. Between portions 28, 30 is a raised center portion 34. A cut line 32 is represented by a dashed line 32, and later in the process a longitudinal cut will be made along this line to produce the individual resistors. The ribbon 24 is of unitary construction, and is formed of an electrically resistive material. The preferred material for the resistive material is copper nickel, but other well known resistive materials such as nickel iron, nickel chromium or a copper based alloy may be used.

In one form of the present invention the forming of the raised portion 34 is done by roll forming the resistive strip either before it is wound upon the reel 22, or after it has been unwound from the reel 22, but before it has been punched or formed into individual resistors.

In another form of the invention, the resistive material 24 is in a flat unformed state on the reel 22, and is unwound and formed into individual resistors before the raised portion 34 is formed. In this modified form of the invention the forming of the raised portion 34 may be accomplished by stamping and is preferably accomplished before the individual resistors are separated from the strip.

The numeral 36 in FIG. 2 represents the step of roll forming the resistive strip either before it is placed on reel 22 or immediately thereafter.

The carrier portion 26 of strip 24 is used as an indexing device for carrying the resistors through the entire manufacturing operation.

The next step which is performed on the strip 24 is the punching of transfer holes, represented by block 38 in FIG. 2. Holes 40 are punched into the carrier strip 26 and are used for indexing the strip through the manufacturing process.

Figure 4:
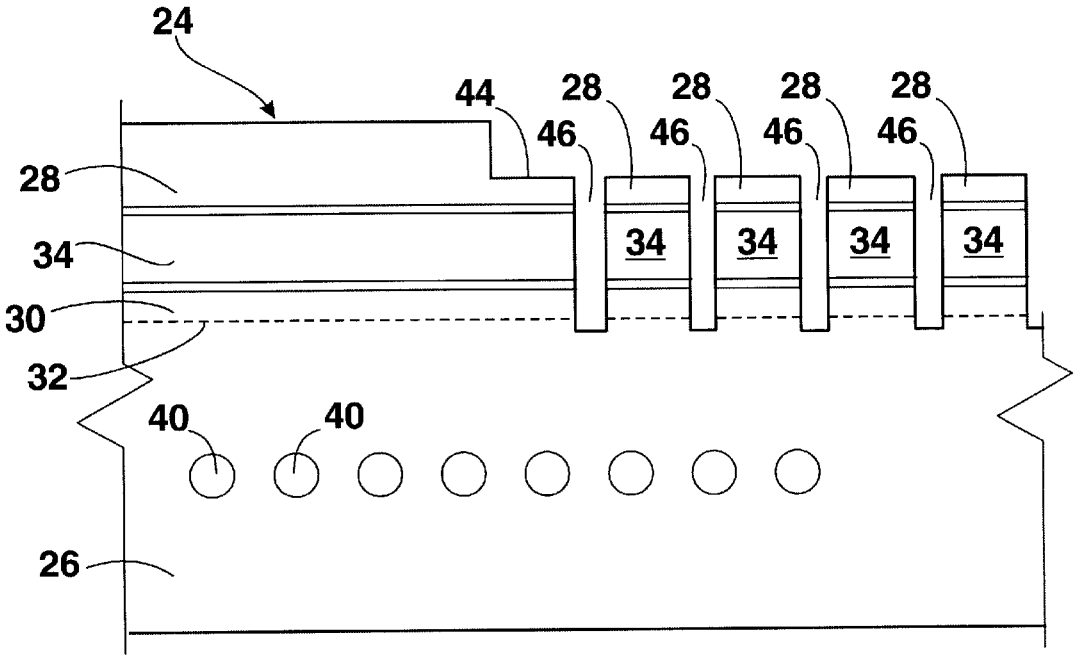
FIG. 4 is an enlarged view taken along line 4—4 of FIG. 2.

The next step performed on the strip 24 is the step of separating the individual resistor bodies from one another and is represented by the block 42 in FIG. 2. FIG. 4 illustrates the manner in which this separation process is accomplished. The upper edge of strip 24 is trimmed to provide an upper edge 44 for each of the resistor elements. At the same time a separating slot 46 is formed between each of the resistor bodies. The slots 46 protrude downwardly slightly below the cut line 32. While various methods may be used for cutting or forming the edges 44 and the slots 46, the preferred method is to do so by stamping the strip 24.

Figure 5:
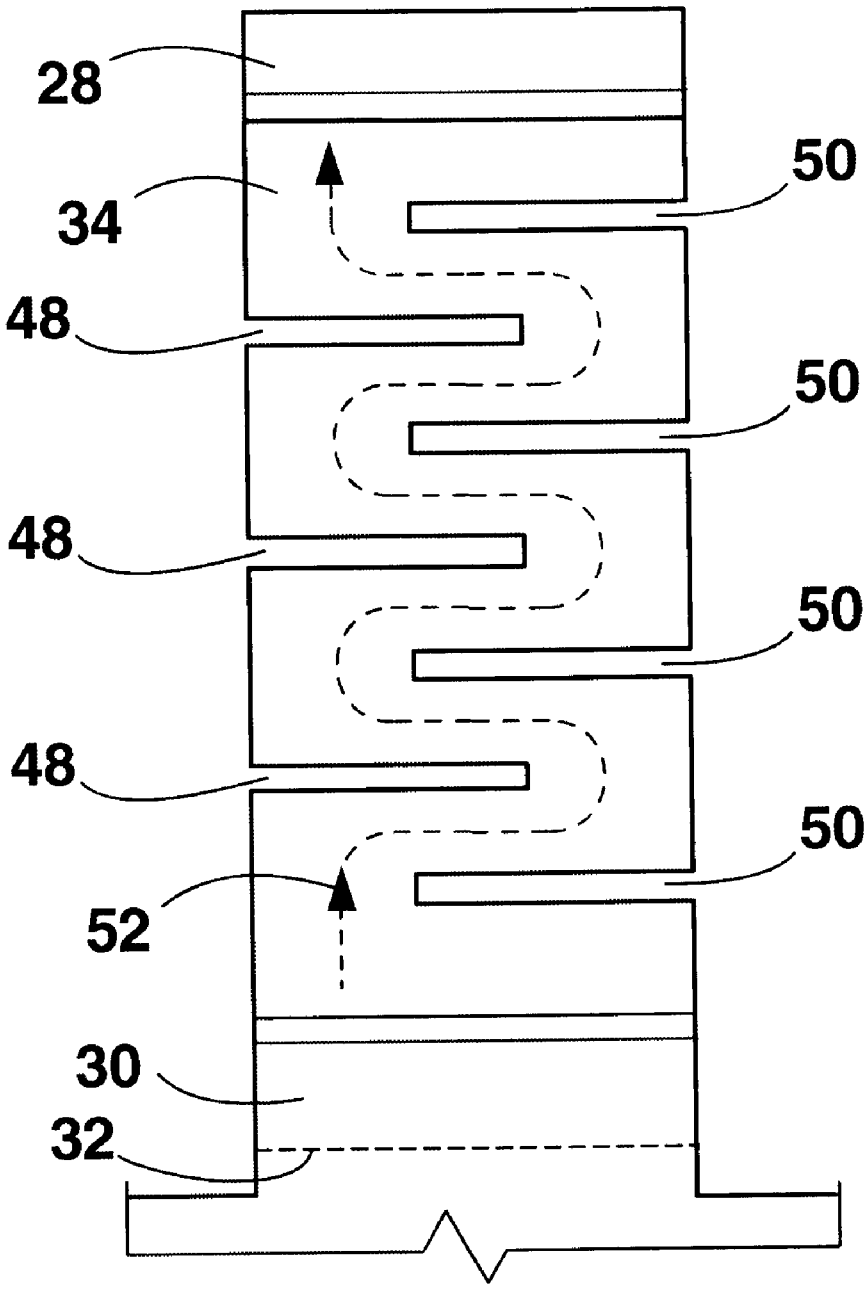
FIG. 5 is an enlarged view taken along line 5—5 of FIG. 2.

FIG. 5 illustrates the result of the adjusting and calibrating step performed on the resistors and represented by the block 60 in FIG. 2. Side slots 48, 50 are formed in the edges of the resistor body so as to create a serpentine path represented by arrow 52 for the current to pass from terminal 28 to 30. During this adjusting process, the slots 48, 50 are cut preferably by laser and the resistance of the resistance body is monitored and measured until the precise resistance value is achieved.

Figure 6:
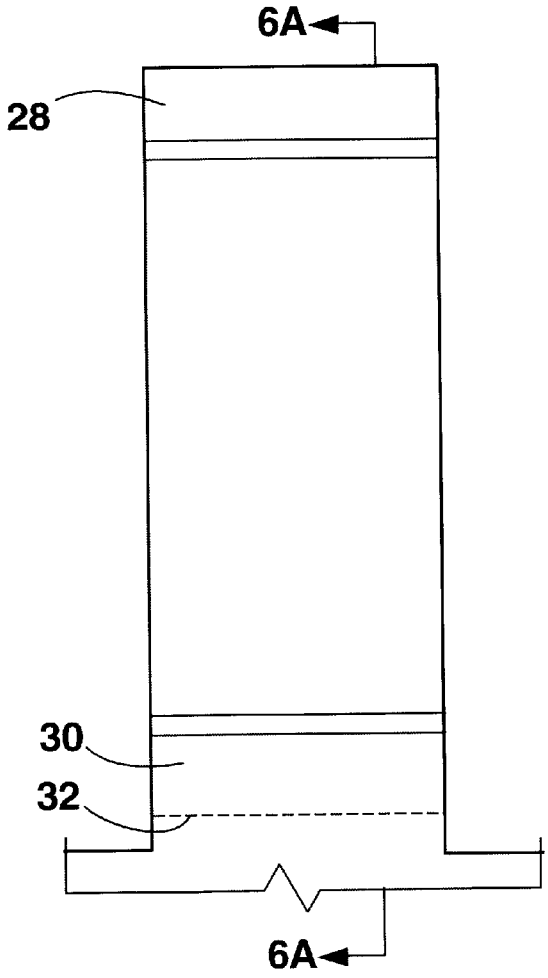
FIG. 6 is an enlarged view taken along line 6—6 of FIG. 2.
Figure 6A:
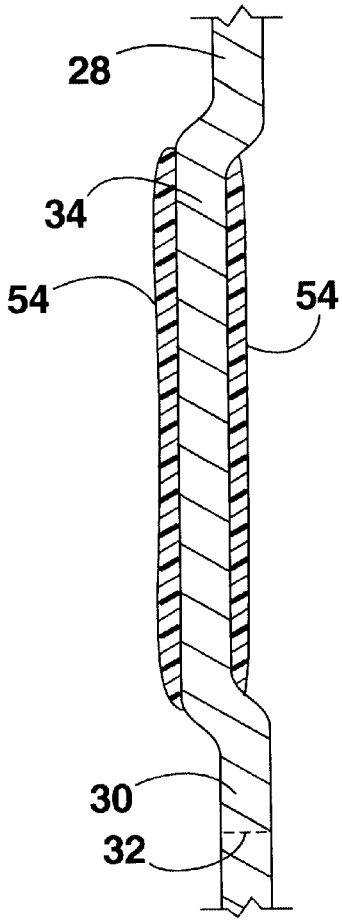
FIG. 6A is a sectional view taken along line 6A—6A of FIG. 6.

The next step to be performed on the resistor is the encapsulation of the central portion within a dielectric material, and is represented by block 62 in FIG. 2. As can be seen in FIGS. 6 and 6A the dielectric material 54 is applied so that it surrounds the entire central portion 34 of the resistor blank.

The purposes of the encapsulating operation include providing protection from various environments to which the resistor may be exposed; adding rigidity to the resistance element which has been weakened by the value adjustment operation; and providing a dielectric insulation to insulate the resistor from other components or metallic surfaces it may contact during its actual operation. The encapsulating material 54 is applied in a manner which only covers the central portion 34. A liquid high temperature coating material roll coated to both sides of the central portion 34 is the preferred method. The terminal ends 28, 30 of the resistor blank are left exposed.

Figure 7:
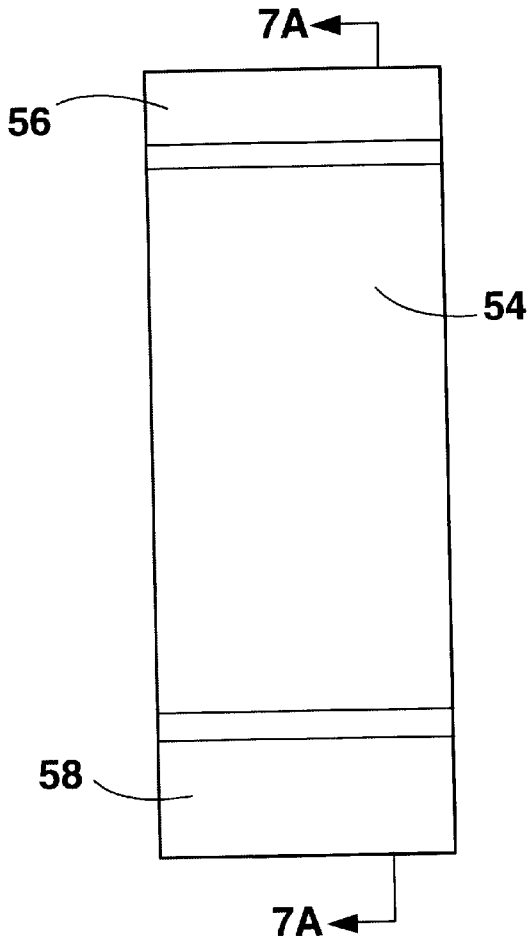
FIG. 7 is an enlarged view taken along line 7—7 of FIG. 2.
Figure 7A:
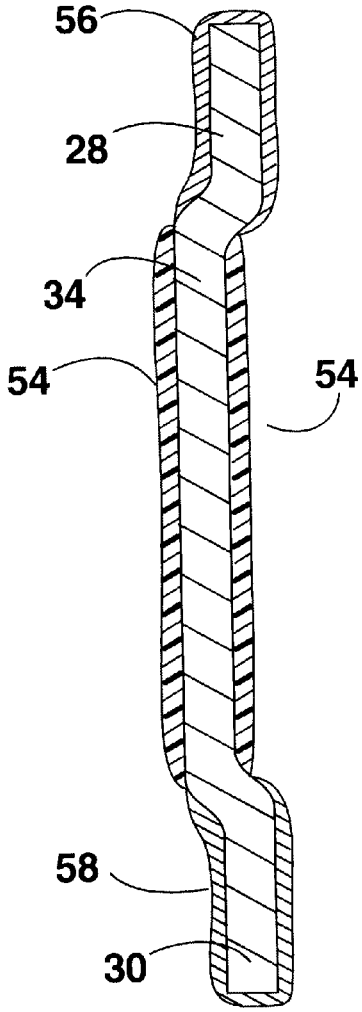
FIG. 7A is a sectional view taken along line 7A—7A of FIG. 7.

Next in the manufacturing process is the application of marking information, printing, to the encapsulated front surface of the resistor. This step is represented by block 64 in FIG. 2. This is accomplished by transfer printing the necessary information on the front surface of the resistor with marking ink. The strip is then moved to the separating station represented by block 65 where the individual resistors are cut away from the carrier strip 24. The individual resistors are plated with solder to create a solder coating 58 as shown in FIG. 7A. The individual resistors 10 are then complete and they are attached to a plastic tape 68 at a packaging station represented by the numeral 66.

The forming of the raised portion 34 can be accomplished at various stages of the manufacturing process as desired. For example, the raised portion can be roll formed before the strip 24 is placed on reel 22, or it can be roll formed immediately after it is unwound from reel 22. A further modified form of the method may involve waiting until after the separation step 42 and the adjust and calibrate step 60 before stamping the individual resistor blanks to create the raised portion 34. The advantage of this later method is that the raised portion is not deformed or bent during the performance of the punching step 38, the separating step 42, or the adjust and calibration step 60.

The preferred method for forming the transfer holes, for trimming the upper edge of the strip to length, and forming the separate resistor blanks is stamping or punching. However, other methods such as cutting with lasers, drilling, etching, and grinding may be used.

The preferred method for calibrating the resistor is to cut the resistor with a laser. However, punching, milling, grinding or other conventional means may be used.

The dielectric material used for the resistor is preferably a rolled high temperature coating, but various types of paint, silicon, and glass in the forms of liquid, powder, or paste may be used. They may be applied by molding, spraying, brushing, or static dispensing.

The solder that is applied may be a plating which is preferable or could also be a conventional solder paste or hot solder dip material.

The marking ink used for the resistor is preferably a white liquid, but various colors and types of marking ink may be used. They may be applied by transfer pad, ink jet, transfer roller. The marking may also be accomplished by use of a marking laser beam.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention as further defined in the following claims.

What is claimed is:

1. A method for making a plurality of surface mount resistors comprising:

taking an elongated unitary ribbon of only electrically resistive material having upper and lower ribbon edges;

partially separating said elongated ribbon into a plurality of individual body members, each having opposite side edges and first and second terminal ends with a central portion there between, said ribbon having a carrier portion interconnecting said plurality of said body members, each of said body members comprising only said resistive material;

forming a plurality of slots in said opposite side edges of said body members so as to create a serpentine current path from said first terminal end through said central portion to said second terminal end in each of said body members;

forming the cross sectional shape of said body members by roll forming said resistive material before said separating step so that said central portion of each of said body members is raised above said first and second terminal ends;

encapsulating said raised central portion of resistive material within a dielectric material;

coating said first and second terminal ends of resistive material with an electrically conductive material.

2. A method according to claim 1 wherein said step of forming the cross sectional shape of said body members is performed by forming said ribbon before said separating step.

3. A method according to claim 2 wherein said step of forming the cross sectional shape of said body members is performed by roll forming said ribbon before said separating step.

4. A method according to claim 1 wherein said step of forming the cross sectional shape of said body members is performed on said body members after said separating step.

5. A method according to claim 4 wherein said step of forming the cross sectional shape of said body members is performed by stamping said body members.

6. A method for making a surface mount resistor comprising:

making a ribbon body member that is flat and lies substantially in a first plane, said body member being unitary comprised of only electrically resistive material and having a longitudinal axis, opposite side edges, first and second terminal ends, and a central portion between said first and second opposite ends;

cutting a plurality of slots in said opposite side edges of said body member so as to create a serpentine current path from said first terminal end through said central portion to said second terminal end;

for forming or stamping said body member of only electrically resistive material so that said central portion of said body member is raised above said first and second terminal ends and is outside said first plane and said first and second terminals remain substantially within said first plane;

encapsulating said raised central portion of said resistive material within a dielectric material; coating said fist and second terminal ends of resistive material with an electrically conductive material.

7. A method for making a plurality of surface mount resistors comprising:

taking an elongated unitary ribbon of only electrically resistive material having upper and lower ribbon edges;

partially separating said elongated ribbon into a plurality of individual body members, each having opposite side edges and first and second terminal ends with a central portion there between, said ribbon having a carrier portion interconnecting said plurality of said body members, each of said body members comprising only said resistive material;

forming a plurality of slots in said opposite side edges of said body members so as to create a serpentine current path from said first terminal end through said central portion to said second terminal end in each of said body members;

forming the cross sectional shape of said body members by stamping said resistive material after said separating step so that said central portion of each of said body members is raised above said first and second terminal ends;

encapsulating said raised central portion of resistive material within a dielectric material;

coating said first and second terminal ends of resistive material with an electrically conductive material.

* * * * *